US011756476B1

(12) United States Patent
Song et al.

(10) Patent No.: US 11,756,476 B1
(45) Date of Patent: Sep. 12, 2023

(54) DISPLAY DEVICE AND OPERATING METHOD THEREOF

(71) Applicant: LG ELECTRONICS INC., Seoul (KR)

(72) Inventors: Chungwon Song, Seoul (KR); Suwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/804,494

(22) Filed: May 27, 2022

(30) Foreign Application Priority Data

Apr. 26, 2022 (KR) ..... 10-2022-0051244

(51) Int. Cl.
*G09G 3/20* (2006.01)
*G09G 3/34* (2006.01)
*G09G 3/36* (2006.01)

(52) U.S. Cl.
CPC ..... *G09G 3/2096* (2013.01); *G09G 3/3406* (2013.01); *G09G 3/36* (2013.01); *G09G 2320/0247* (2013.01); *G09G 2320/064* (2013.01); *G09G 2320/0653* (2013.01); *G09G 2340/0435* (2013.01); *G09G 2370/12* (2013.01)

(58) Field of Classification Search
CPC ..... G09G 3/2096; G09G 3/3406; G09G 3/36; G09G 2320/0247; G09G 2320/064; G09G 2320/0653; G09G 2340/0435; G09G 2370/12
See application file for complete search history.

(56) References Cited

U.S. PATENT DOCUMENTS

2010/0053228 A1* 3/2010 Yeo ..... G09G 3/3406 345/690
2015/0103104 A1* 4/2015 Lee ..... G09G 3/3648 345/690
2015/0179111 A1* 6/2015 Chen ..... G09G 3/3426 345/88
2022/0014649 A1* 1/2022 Lin ..... G09G 5/12

OTHER PUBLICATIONS

AMD, https://www.youtube.com/watch?v=ZyrfUIJA7Sc Jun. 2018.*
Sony, https://www.youtube.com/watch?v=87DRIIQh3RI Apr. 2022.*

* cited by examiner

*Primary Examiner* — Michael Pervan
(74) *Attorney, Agent, or Firm* — LEE, HONG, DEGERMAN, KANG & WAIMEY PC

(57) ABSTRACT

A display device includes a display panel, a backlight unit configured to provide light to the display panel, an external input interface configured to receive an image signal and image information about the image signal from an external device, and a processor configured to, when a frequency of the image signal is reduced from a first frequency to a second frequency according to a variable refresh rate (VRR) operation, transmit a local dimming signal based on a third frequency between the first frequency and the second frequency to the backlight unit.

20 Claims, 5 Drawing Sheets

FIG. 3

300

| Packet Byte# | 7 | 6 | 5 | 4 | 3 | 2 | 1 | 0 |
|---|---|---|---|---|---|---|---|---|
| PB0 | Checksum | | | | | | | |
| PB1 | 24bit AMD IEEE OUI (0x00001A) (least significant byte first) PB1 0x1A, PB2=0x00,PB3=0x00 | | | | | | | |
| PB2 | | | | | | | | |
| PB3 | | | | | | | | |
| PB4 | Reserved=0 | | | | | 330 | 320 | 310 |
| PB5 | | | | | | | | |
| PB6 | Reserved=0 | | Bit 5 = Local Dimming Disable | Bit 4 = Brightness Control Active (PB 10) | Bit 3 = Native Color Space Active (PB 9) | Bit 2 = FreeSync Actuve | Bit 1 = FreeSync Enabled | Bit 0 = FreeSync Supported |
| PB7 | FreeSync Minimum refresh rate(Hz) | | | | | | | |
| PB8 | FreeSync Minimum refresh rate(Hz) | | | | | | | |
| PB9 | Reserved=0 | | Bit 5 = PQ EOTF Active | Bit 4 = Reserved (0) | Bit 3 = Gamma 2.6 EOTF Active | Bit 2 = Gamma 2.2 EOTF Active | Bit 1 = BT709 EOTF Active | Bit 0 = sRGB EOTF Active |
| PB10 | Brightness Control(%) | | | | | | | |
| PB11-PB27 | Reserved=0 | | | | | | | |

Table 4.9:Source Product Descriptor InfoFrame Fields Version 2

400

410

Table 10-31:Video Timing Extended Metadata Structure

| Byte \ Bit # | 7 | 6 | 5 | 4 | 3 | 2 | 1 | 0 |
|---|---|---|---|---|---|---|---|---|
| MD0 | FVA_Factor_M1[3..0] | | | | Reserved(0) | | M_CONST | VRR_EN |
| MD1 | Base_Vfront | | | | | | | |
| MD2 | Reserved(0) | | | | | RB | Base_Refresh_Rate[9:8] | |
| MD3 | Base_Refresh_Rate[7:0] | | | | | | | |

FIG. 6

| FreeSync Operation UI | | | Flicker-free (x4) | |
|---|---|---|---|---|
| Engineer UI | TV Freesync UI | PC VRR UI | L/Dim Vsync | LED Output |
| Fixed | OFF | OFF | 120Hz | 120Hz |
| Freesync_Supported | WIDE/HIGH | OFF | 120Hz | 120Hz |
| Freesync_Enabled | WIDE/HIGH | ON | **60Hz** | **240Hz** |
| Freesync_Active | Freesync/VRR working | | **60Hz** | **240Hz** |

DISPLAY DEVICE AND OPERATING METHOD THEREOF

CROSS-REFERENCE TO RELATED APPLICATIONS

Pursuant to 35 U.S.C. § 119(a), this application claims the benefit of earlier filing date and right of priority to Korean Patent Application No. 10-2022-0051244, filed on Apr. 26, 2022, the contents of which are hereby incorporated by reference herein in its entirety.

BACKGROUND

The present disclosure relates to a display device and an operating method thereof, and relates to improving an abnormal phenomenon on a screen according to a change in frequency.

A display device for reproducing a game video may display more scenes for the same time than a display device operating at a scan rate of 60 Hz.

A user may feel a much smoother screen as a scan rate is higher. Also, a high scan rate is required in a game that requires a fast response speed.

In addition, when a game video is reproduced, a tearing phenomenon may occur. That is, a screen may be horizontally shifted. The tearing phenomenon occurs when a scan rate of an image is fixed and an image frame output by a graphic card is not synchronized with an image frame output by a display panel.

In order to prevent the tearing phenomenon, a variable scan rate (or a variable refresh rate (VRR)) technology for synchronizing a frequency of an image signal output by a source device (e.g., a graphic card of a PC) with a scan rate of a display panel has emerged.

However, if the frequency of the image signal output by the source device drops rapidly below a certain ratio, a light output of a liquid crystal display fails to track the changed frequency of the image signal, and the output flows and wavy noise is output to the display panel.

SUMMARY

The present disclosure aims to improve an erroneous operation of an LED driving circuit when an image frequency changes rapidly during a variable refresh rate (VRR) operation.

The present disclosure aims to remove wavy noise under a condition in which a frequency of an input image signal drops rapidly during a VRR operation.

According to an embodiment of the present disclosure, a display device includes a display panel, a backlight unit configured to provide light to the display panel, an external input interface configured to receive an image signal and image information about the image signal from an external device, and a processor configured to, when a frequency of the image signal is reduced from a first frequency to a second frequency according to a variable refresh rate (VRR) operation, transmit a local dimming signal based on a third frequency between the first frequency and the second frequency to the backlight unit.

According to an embodiment of the present disclosure, an operating method of a display device including a display panel and a backlight unit configured to provide light to the display panel includes receiving an image signal and image information about the image signal from an external device, detecting a change in a variable refresh rate (VRR) operation, and when the change in the VRR operation in which a frequency of the image signal is reduced from a first frequency to a second frequency is detected, transmitting a local dimming signal based on a third frequency between the first frequency and the second frequency to the backlight unit.

BRIEF DESCRIPTION OF THE DRAWINGS

FIG. 3 is a diagram for describing an example of source product descriptor (SPD) information according to an embodiment of the present disclosure.

FIG. 6 is a diagram for describing a concept of a FreeSync operation according to an embodiment of the present disclosure.

DETAILED DESCRIPTION OF THE EMBODIMENTS

Hereinafter, the present disclosure will be described in more detail with reference to the drawings.

Figure 1:
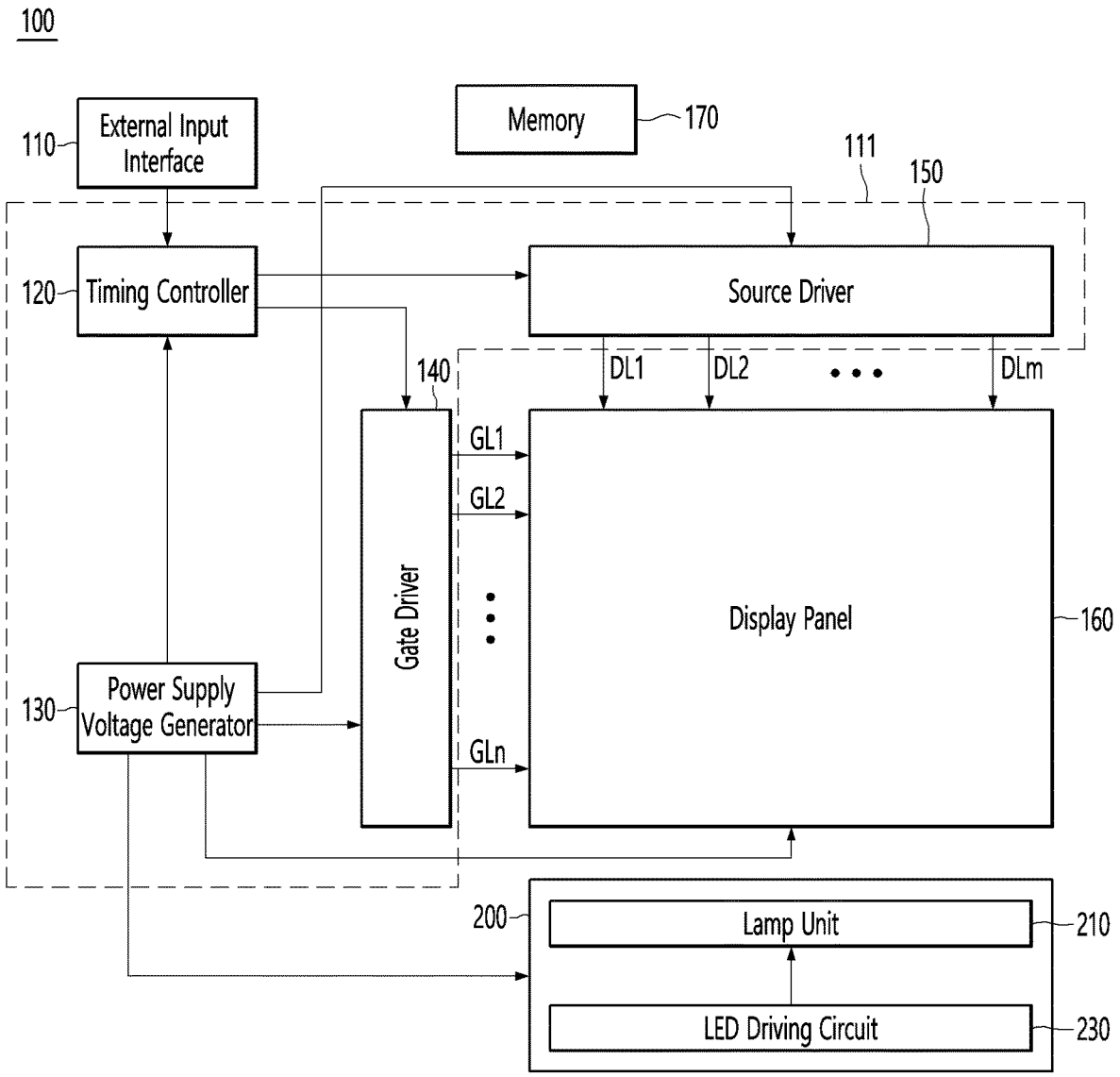
FIG. 1 is a block diagram illustrating a configuration of a display device according to an embodiment of the present disclosure.

FIG. 1 is a diagram illustrating a display device according to an embodiment of the present disclosure.

A display device 100 of FIG. 1 may be one of a monitor, a TV, a tablet PC, and a mobile terminal.

The display device 100 may include an external input interface 110, a processor 111, a display panel 160, and a backlight unit 200.

The external input interface 110 may receive image data from an external device.

The external device may be a source device with a graphic card, such as a computer, a laptop computer, or a TV.

The external input interface 110 may include one or more HDMI terminals and one or more A/V terminals.

The display panel 160 may be a liquid crystal display panel.

The display panel 160 may display an image based on an image signal input from the external input interface 110.

The display panel 160 may include a plurality of data lines DL1 to DLm and a plurality of gate lines GL1 to GLn, which intersect in a matrix form on a substrate using glass, and a plurality of pixels corresponding to the respective intersection points.

Each of the plurality of pixels may output an image based on an image signal provided from a source driver 150, a driving signal provided to a gate driver 140, and light provided from the backlight unit 200.

A memory 170 may store programs and information necessary for driving the display panel 160.

The backlight unit 200 may provide light to the display panel 160.

The external input interface 110 may receive, from the external device, a control signal including at least one of image data (RGB data), a clock signal, a horizontal synchronization signal, a vertical synchronization signal, and a data enable signal.

The horizontal synchronization signal may be a signal for synchronizing the horizontal direction of the screen.

The vertical synchronization signal may be a signal for synchronizing the vertical direction of the screen.

In addition, the data enable signal may represent a period during which data is supplied to the pixel.

The external input interface 110 may be included in the processor 111.

The processor 111 may include a timing controller 120, a power supply voltage generator 130, the gate driver 140, and the source driver 150.

The timing controller 120 may use the control signal received from the external input interface 110 to generate a driving signal for driving the gate driver 140 including a plurality of driver integrated circuits and the source driver 150 including a plurality of drive integrated circuits.

For example, the driving signal for driving the gate driver 140 may include a high signal, a gate low signal, a clock signal, a start signal, and a reset signal.

The power supply voltage generator 130 may supply a power supply voltage, a reference voltage, a ground voltage, and the like necessary for the operation of each component included in the processor 111.

The power supply voltage generator 130 may supply, to the display panel 160, a common voltage corresponding to the reference voltage.

The power supply voltage generator 130 may supply DC power (LED B+) necessary for driving the backlight unit 200.

The gate driver 140 may perform on/off control of each of the plurality of pixels included in the display panel 160 in response to the driving signal input from the timing controller 120.

The gate driver 140 may output gate driving signals Vg1 to Vgn to sequentially enable the gate lines GL1 to GLn on the display panel 160 by one horizontal synchronization time.

Accordingly, image signals supplied from the source driver 150 may be applied to the respective pixels.

The source driver 150 may apply an image signal to each pixel in response to a data signal and a driving signal input from the timing controller 120.

The backlight unit 200 may be disposed on one surface of the display panel 160 to provide light to the display panel 160.

The backlight unit 200 may include a lamp unit 210 and an LED driving circuit 230.

The lamp unit 210 may provide light to the display panel 160.

The lamp unit 210 may provide light to the display panel 160 so that the display panel 160 implements an image according to the control of the LED driving circuit 230.

To this end, a local dimming method may be used. Local dimming may be a method of turning on or off lighting in a specific area of a screen.

Local dimming may be used to implement HDR images.

The lamp unit 210 may include a plurality of channels. Each of the channels may include one or more LED elements connected in series, a dimming circuit, and a resistor.

Each of the LED elements may emit red, green, and blue monochromatic light or white light.

The dimming circuit may be a semiconductor switch capable of turning on or off the one or more LED elements.

The dimming circuit may be configured as a field effect transistor (FET).

The resistor may be used to measure a current flowing through one channel. The DC voltage supplied from the power supply voltage generator 130 to the lamp unit 210 may drops while passing through the one or more LED elements, and the dropped voltage may be applied to the resistor.

By measuring the voltage across the resistor, the current flowing through the channel may be measured.

The plurality of channels may be connected in parallel and electrically connected to the LED driving circuit 230.

The LED driving circuit 230 may control the operation of the lamp unit 210.

The LED driving circuit 230 may include a plurality of LED drivers.

The number of LED drivers included in the LED driving circuit 230 may be less than the number of channels included in the lamp unit 210.

The number of LED drivers may be equal to the number of dimming circuits. That is, the number of dimming circuits may also be less than the number of channels.

The LED driving circuit 230 may supply power to the lamp unit 210 according to a pulse width modulation (PWM) driving signal.

The LED driving circuit 230 may drive the lamp unit 210 by generating a driving signal having a frequency obtained by multiplying the frequency of the synchronization signal of the input image by a certain ratio. The synchronization signal may include a vertical synchronization signal and a horizontal synchronization signal.

The LED driving circuit 230 may synchronize the frequency of the synchronization signal with the frequency of the driving signal at a certain ratio. The frequency of the synchronization signal and the output frequency of the display panel 160 may be the same. The LED driving circuit 230 may make a value obtained by multiplying the output frequency of the display panel 160 by the corresponding ratio (multiplying rate) to be equal to the frequency of the driving signal.

Figure 2:
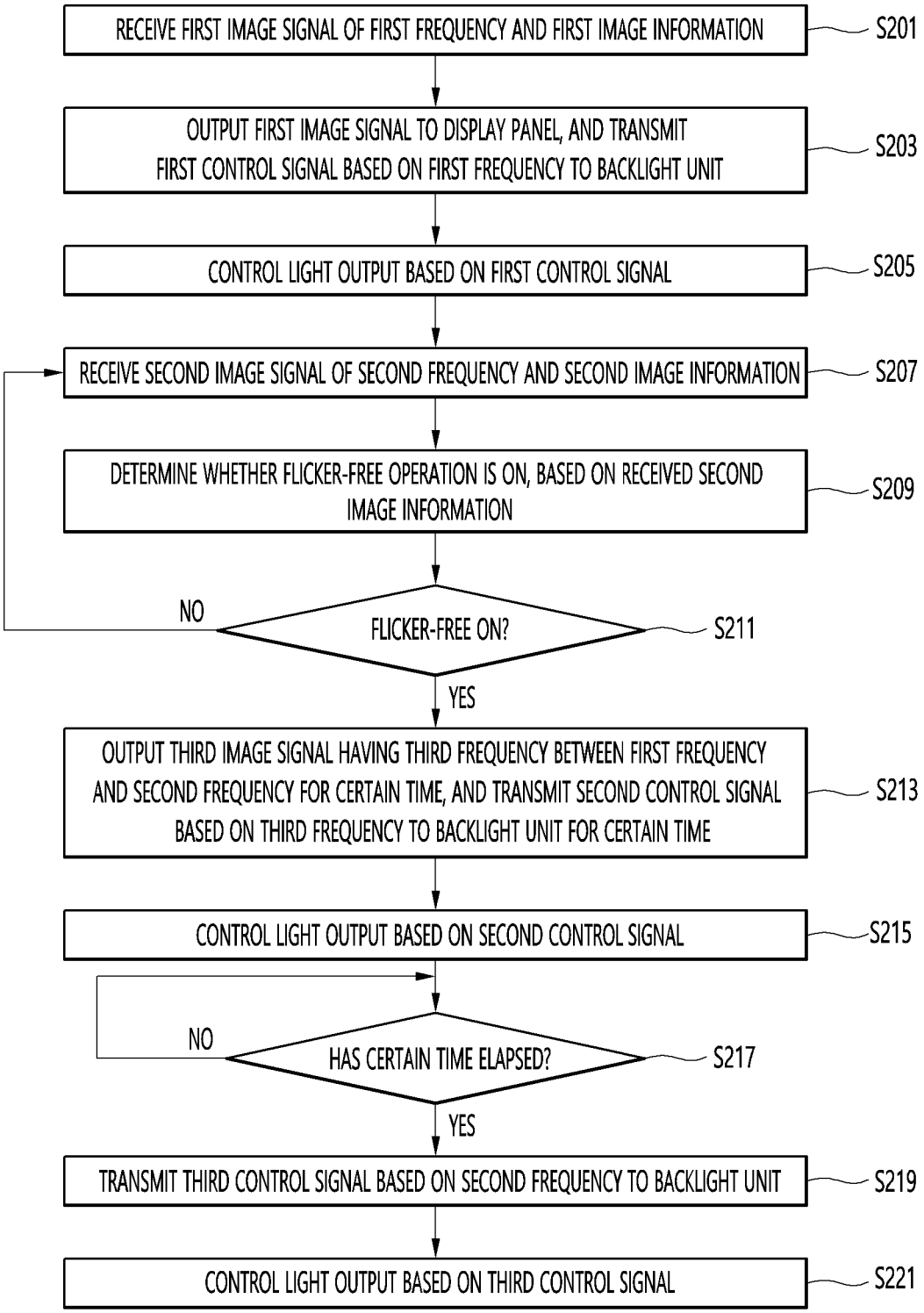
FIG. 2 is a flowchart for describing an operating method of a display device according to an embodiment of the present disclosure.

FIG. 2 is a flowchart for describing an operating method of the display device according to an embodiment of the present disclosure.

Hereinafter, the frequency may refer to a scan rate of an image frame. Hereinafter, it is assumed that the image signal is a signal including the vertical synchronization signal Vsync.

Referring to FIG. 2, the external input interface 110 of the display device 100 receives a first image signal of a first frequency and first image information from the external device (S201).

In an embodiment, the external device may be a source device with a graphic card, such as a PC, a laptop computer, or a TV.

The external input interface 110 may include one or more HDMI terminals.

The external input interface 110 may receive an image signal and image information from the external device through an HDMI cable.

The first image information may include frequency information of the first image signal. The frequency of the first image signal may be obtained based on a clock signal of an image signal.

The first image information may further include information about a flicker-free operation. Specifically, the first image information may include information indicating on or off of the flicker-free operation.

The flicker-free operation may be an operation of controlling light output of the lamp unit 210 of the backlight unit 200 by multiplying the frequency of the image signal by a certain ratio in order to prevent the flicker phenomenon occurring when the frequency of the image signal drops rapidly to a low frequency.

In an embodiment, the first image information may include source product descriptor (SPD) information when the external device supports FreeSync.

FreeSync may be a specification for a variable refresh rate (VRR) function supported by a specific company.

The SPD information may include information about an on or off state of a VRR. That is, the SPD information may include information about on or off of the VRR function. The SPD information will be described below.

In another embodiment, the first image information may include video timing extended metadata (VTEM). The VTEM may include information about enabling or disabling the VRR function or a VRR mode.

The VTEM to the will be described below.

The processor 111 of the display device 100 outputs the first image signal to the display panel 160 and transmits a first control signal based on the first frequency to the backlight unit 200 (S203).

The timing controller 120 of the processor 111 may transmit the first image signal of the first frequency to the source driver 150.

The first control signal based on the first frequency may be a signal for local dimming control of the backlight unit 200. The first control signal may be a pulse width modulation (PWM) signal.

That is, the first control signal may be a first local dimming signal for controlling the LED driving circuit 230.

The backlight unit 200 of the display device 100 controls the light output of the lamp unit 210 based on the first control signal (S205).

The LED driving circuit 230 of the backlight unit 200 may transmit a first driving signal based on the first local dimming signal to the lamp unit 210. The lamp unit 210 may locally output light based on the first driving signal.

The external input interface 110 of the display device 100 receives a second image signal of a second frequency and second image information from the external device (S207).

The second frequency may be lower than the first frequency.

The second frequency may be lower than the first frequency by a certain ratio.

When the first frequency is 120 Hz, the second frequency may be 60 Hz.

The second image information may include frequency information of the second image signal and information indicating on or off of the flicker-free operation.

Hereinafter, examples of the first and second image information will be described.

Figures 4, 5:
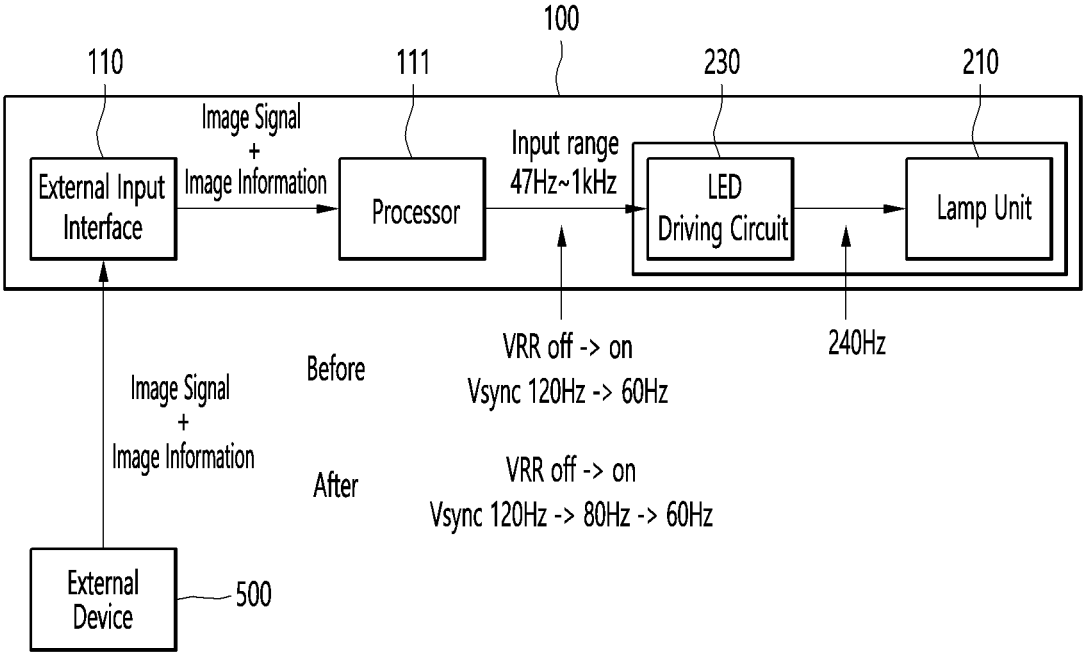
FIG. 4 is a diagram for describing video timing extended metadata (VTEM) according to an embodiment of the present disclosure.
FIG. 5 is a diagram for describing a process of controlling an LED driving circuit by applying an intermediate frequency during a flicker-free on operation according to an embodiment of the present disclosure.

FIG. 3 is a diagram for describing an example of SPD information according to an embodiment of the present disclosure, and FIG. 4 is a diagram for describing VTEM according to an embodiment of the present disclosure.

When the external device connected through the external input interface 110 of the display device 100 supports FreeSync, the display device 100 may receive SPD information 300 illustrated in FIG. 3.

When the external device connected through the external input interface 110 of the display device 100 does not support FreeSync, the display device 100 may receive VTEM 400 illustrated in FIG. 4.

First, FIG. 3 is described.

For convenience, it is assumed that the FreeSync is a VRR function.

Referring to FIG. 3, the SPD information 300 may include a first bit field 310 indicating that FreeSync is supported, a second bit field 320 indicating that FreeSync is enabled or disabled, and third bit field 330 indicating that FreeSync is active or non-active.

The second bit field 320 may be a field indicating whether FreeSync is ready to be applied.

The third bit field 330 may be a field indicating whether FreeSync is actually being operated.

The processor 111 may determine whether the flicker-free operation is on, based on the SPD information 300 received through the external input interface 110.

For example, when the value of the second bit field 320 included in the SPD information 300 is enabled and the value of the third bit field 330 is active, the processor 111 may determine that a flicker-free on state has occurred.

That is, when the value of the second bit field 320 included in the SPD information 300 is enabled and the value of the third bit field 330 is active, the processor 111 may determine that the VRR is changed from an off state to an on state.

Next, FIG. 4 is described.

VTEM 400 of FIG. 4 may conform to the High Definition Multimedia Interface (HDMI) 2.1 standard.

Referring to FIG. 4, a MDO field of the VTEM 400 may include information indicating that a VRR function is enabled or disabled.

When a value of a VRR field 410 of the MDO field is 1, the processor 111 may determine that the VRR function is enabled. That is, when the value of the VRR field 410 of the MDO field is 1, the processor 111 may determine that the VRR operation is changed from an off state to an on state.

When the value of the VRR field 410 of the MDO field is 0, the processor 111 may determine that the VRR function is disabled. That is, when the value of the VRR field 410 of the MDO field is 1, the processor 111 may determine that the VRR operation is in an off state.

Again, FIG. 2 is described.

The processor 111 of the display device 100 determines whether the flicker-free operation is on, based on the received second image information (S209).

The processor 111 may determine whether the flicker-free operation is on by comparing the first image information with the second image information.

In an embodiment, when the VRR function is changed from an off state to an on state, the processor 111 may determine that the flicker-free operation is on. That is, the processor 111 may detect a change in VRR operation.

In another embodiment, when the VRR function is changed from an off state to an on state and the second frequency is reduced to less than or equal to a certain ratio of the first frequency, the processor 111 may determine that the flicker-free operation is on. The certain ratio may be 55%, but this is only an example.

When the processor 111 of the display device 100 determines that the flicker-free operation is on (S211), the processor 111 outputs a third image signal of a third frequency between the first frequency and the second frequency to the display panel 160 for a certain time, and transmits a second control signal based on the third frequency to the backlight unit 200 for a certain time (S213).

When the processor 111 determines that the flicker-free operation is on, the processor 111 may apply the third frequency between the first frequency and the second frequency to the output of the lamp unit 210 in order to remove wavy noise occurring when the light output of the lamp unit 210 fails to track the second frequency.

To this end, the processor 111 may determine the third frequency that is an intermediate frequency between the first frequency and the second frequency.

For example, the third frequency may be an average value between the first frequency and the second frequency.

As another example, the third frequency may be a frequency greater than a value reduced from the first frequency by a certain ratio.

When the first frequency is 120 Hz and the second frequency is 60 Hz, the third frequency may be 80 Hz.

The certain time may be 650 ms, but this is only an example.

The processor 111 may output the third image signal having the third frequency to the display panel 160 and transmit, to the backlight unit 200, the second control signal including information about the third frequency.

The second control signal may be a signal for controlling the local dimming operation of the backlight unit 200 based on the third frequency.

The backlight unit 200 of the display device 100 controls the light output of the lamp unit 210 based on the second control signal (S215).

The backlight unit 200 may control the light output of the lamp unit 210 based on the second control signal only for a certain time.

The processor 111 determines whether the certain time has elapsed (S217). When the processor 111 determines that the certain time has elapsed, the processor 111 transmits the third control signal based on the second frequency to the backlight unit 200 (S219).

When the processor 111 determines that the certain time has elapsed, the processor 111 may transmit a third control signal based on the second frequency to the backlight unit 200 in order to control the light output of the lamp unit 210 based on the second frequency, that is a frequency changed according to the on of the VRR operation.

The backlight unit 200 controls the light output of the lamp unit 210 based on the third control signal (S221).

The LED driving circuit 230 of the backlight unit 200 may determine a fourth frequency obtained by multiplying the second frequency included in the third control signal by a certain ratio, and output a driving signal having the determined fourth frequency to the lamp unit 210.

For example, the fourth frequency may be four times the second frequency.

This is for suppressing the occurrence of flicker by increasing the frequency by a certain ratio because flicker may occur when the first frequency is rapidly decreased to the second frequency.

FIG. 5 is a diagram for describing a process of controlling an LED driving circuit by applying an intermediate frequency during a flicker-free on operation according to an embodiment of the present disclosure.

Referring to FIG. 5, an external device 500 may transmit an image signal and image information about the image signal to an external input interface 110 of a display device 100.

The image information may include information for determining a frequency of an image signal and whether flicker-free are on or off.

The image information may include the SPD information 300 or the VTEM 400 described with reference to FIG. 3.

When the VRR function is changed from an off state to an on state based on the SPD information 300 or the VTEM 400, the processor 111 may determine that the flicker-free operation is on.

When the VRR function is changed from an off state to an on state, the processor 111 may determine an intermediate frequency for local dimming to be transmitted to an LED driving circuit 230, and may transmit, to the LED driving circuit 230, a local dimming signal having the determined intermediate frequency.

For example, it is assumed that the frequency of the image signal transmitted through the external input interface 110 in the off state of the VRR operation is 120 Hz, and the frequency of the image signal when the VRR operation is changed to an on state is 60 Hz.

Conventionally, when the VRR operation is changed from an off state to an on state, the local dimming signal having the changed frequency of 60 Hz is transmitted to the LED driving circuit 230. When the frequency drops abruptly below a certain ratio of a previous frequency, the output signal of the LED driving circuit 230 cannot track the dropped frequency and wavy noise occurs.

According to an embodiment of the present disclosure, when the VRR operation is changed from an off state to an on state, the processor 111 may transmit, to the LED driving circuit 230, a local dimming signal of 80 Hz, which is an intermediate frequency between 120 Hz and 60 Hz.

When the processor determines that the reduction ratio of the frequency due to the change of the VRR operation from an off state to an on state is greater than or equal to a certain ratio, the processor 111 may determine an intermediate frequency (80 Hz) and transmit, to the LED driving circuit 230, a local dimming signal having the determined intermediate frequency only for a certain time.

The certain time may be 650 ms, but this is only an example.

Since the LED driving circuit 230 receives a local dimming signal having a frequency in the order of 120 Hz, 80 Hz, and 60 Hz, it may not be recognized that the frequency is rapidly reduced.

As described above, according to the embodiment of the present disclosure, due to the application of the intermediate frequency, wavy noise may be removed under a condition in which the frequency of the input image signal drops rapidly during the VRR operation.

On the other hand, when it is determined that the flicker-free operation is on, the LED driving circuit 230 may obtain the output frequency (240 Hz) obtained by multiplying, by a certain ratio (four times), the frequency (60 Hz) changed when the VRR operation is on.

The LED driving circuit 230 may transmit, to the lamp unit 210, a driving signal for controlling the light output based on the output frequency (240 Hz) to the lamp unit 210. This is for suppressing the occurrence of flicker.

FIG. 6 is a diagram for describing a concept of a FreeSync operation according to an embodiment of the present disclosure.

In FIG. 6, it is assumed that the external device is a PC, the display device 100 is a TV, and FreeSync is used as a standard for VRR.

A FreeSync operation UI may be a user interface for setting a FreeSync function on a screen of a PC or a screen of a TV.

WIDE may indicate a case where a frequency range supporting FreeSync is 48 Hz to 120 Hz, and HIGH may indicate a case where a frequency range supporting FreeSync is 90 Hz to 120 Hz.

In FIG. 6, when the FreeSync function of the PC and the TV is set, the frequency of the local dimming signal (L/Dim Vsync) may be changed from 120 Hz to 60 Hz as the VRR operation is changed from an off state to an on state.

That is, the TV, which is the display device 100, is ready to apply FreeSync based on the SPD information 300 (see FIG. 3) received from the PC (Enabled) and FreeSync is being operated (Active), a light output control signal having a frequency obtained by multiplying the frequency (60 Hz) of the local dimming signal by four times may be transmitted to the lamp unit 210.

The LED output of the lamp unit 210 may have a frequency of 240 Hz.

Of course, the TV may output a local dimming signal having an intermediate frequency between 120 Hz and 60 Hz to the LED driving circuit 230 for a certain time.

According to the present disclosure, due to the application of the intermediate frequency, wavy noise may be removed under a condition in which the frequency of the input image signal drops rapidly during the VRR operation.

In addition, the intermediate frequency is applied only for a certain time under a condition in which the frequency of the input image signal drops rapidly during the VRR operation, and then the output frequency of the backlight unit is multiplied by a certain ratio to prevent the occurrence of flicker.

The present disclosure described above may be embodied as computer-readable code on a medium on which a program is recorded. A computer-readable medium includes any types of recording devices in which data readable by a computer system is stored. Examples of the computer-readable medium include hard disk drive (HDD), solid state disk (SSD), silicon disk drive (SDD), ROM, RAM, CD-ROM, magnetic tape, floppy disk, optical data storage device, and the like. In addition, the computer may include the controller 170 of the display device 100.

What is claimed is:

1. A display device comprising:

a display panel;

a backlight unit configured to provide light to the display panel;

an external input interface configured to receive an image signal and image information about the image signal from an external device; and a processor configured to, based on a frequency of the image signal being reduced from a first frequency to a second frequency according to a variable refresh rate (VRR) operation, transmit a local dimming signal based on a third frequency between the first frequency and the second frequency to the backlight unit.

2. The display device of claim 1, wherein, when the first frequency is changed to the second frequency reduced by a certain ratio, the processor is configured to transmit the local dimming signal based on the third frequency to the backlight unit.

3. The display device of claim 1, wherein the image information includes source product descriptor (SPD) information including whether the VRR operation is supported, whether the VRR operation is enabled, and whether the VRR operation is active.

4. The display device of claim 3, wherein the processor is configured to determine that the VRR operation is changed from an off state to an on state, based on the SPD information.

5. The display device of claim 1, wherein the image information includes metadata conforming to a High Definition Multimedia Interface (HDMI) standard, and wherein the metadata includes a field indicating whether the VRR operation is enabled or disabled.

6. The display device of claim 5, wherein, when the VRR operation is enabled, the processor is configured to determine that the VRR operation is changed from an off state to an on state.

7. The display device of claim 1, wherein the processor is configured to transmit the local dimming signal based on the third frequency to the backlight unit only for a certain time.

8. The display device of claim 7, wherein the processor is configured to transmit a local dimming signal based on the second frequency to the backlight unit after the certain time has elapsed.

9. The display device of claim 1, wherein the backlight unit includes;

an LED driving circuit configured to generate a driving signal according to the local dimming signal; and a lamp unit including a plurality of LEDs, wherein the LED driving circuit is configured to transmit, to the lamp unit, the driving signal having a fourth frequency obtained by multiplying the second frequency by a certain times.

10. The display device of claim 1, wherein, when the VRR operation is changed from an off state to an on state, the processor is configured to determine that a flicker-free operation is on.

11. An operating method of a display device including a display panel and a backlight unit configured to provide light to the display panel, the operating method comprising:

receiving an image signal and image information about the image signal from an external device;

detecting a change in a variable refresh rate (VRR) operation; and based on the change in the VRR operation in which a frequency of the image signal being reduced from a first frequency to a second frequency is detected, transmitting a local dimming signal based on a third frequency between the first frequency and the second frequency to the backlight unit.

12. The operating method of claim 11, wherein the transmitting includes, when the first frequency is changed to the second frequency reduced by a certain ratio, transmitting the local dimming signal based on the third frequency to the backlight unit.

13. The operating method of claim 11, wherein the image information includes source product descriptor (SPD) information including whether the VRR operation is supported, whether the VRR operation is enabled, and whether the VRR operation is active.

14. The operating method of claim 13, wherein the detecting includes determining that the VRR operation is changed from an off state to an on state, based on the SPD information.

15. The operating method of claim 11, wherein the image information includes metadata conforming to a High Definition Multimedia Interface (HDMI) standard, and wherein the metadata includes a field indicating whether the VRR operation is enabled or disabled.

16. The operating method of claim 15, wherein the detecting includes, when the VRR operation is enabled, determining that the VRR operation is changed from an off state to an on state.

17. The operating method of claim 11, wherein the transmitting includes transmitting the local dimming signal based on the third frequency to the backlight unit only for a certain time.

18. The operating method of claim 17, further comprising transmitting a local dimming signal based on the second frequency to the backlight unit after the certain time has elapsed.

19. The operating method of claim 11, wherein the backlight unit includes;

an LED driving circuit configured to generate a driving signal according to the local dimming signal; and a lamp unit including a plurality of LEDs, wherein the LED driving circuit is configured to transmit, to the lamp unit, the driving signal having a fourth frequency obtained by multiplying the second frequency by a certain times.

20. The operating method of claim 11, further comprising, when the VRR operation is changed from an off state to an on state, determining that a flicker-free operation is on.

* * * * *